US008904593B2

(12) United States Patent
Hollows et al.

(10) Patent No.: US 8,904,593 B2
(45) Date of Patent: Dec. 9, 2014

(54) DEVICE AND METHOD FOR CLEANING A GOLF BALL

(75) Inventors: Brent Hollows, Mission Viejo, CA (US); Michelle Basta, Mission Viejo, CA (US)

(73) Assignee: Macro Products, Inc., Irvine, CA (US)

( * ) Notice: Subject to any disclaimer, the term of this patent is extended or adjusted under 35 U.S.C. 154(b) by 1244 days.

(21) Appl. No.: 12/051,821

(22) Filed: Mar. 19, 2008

(65) Prior Publication Data

US 2009/0031517 A1 Feb. 5, 2009

Related U.S. Application Data

(60) Provisional application No. 60/925,652, filed on Apr. 23, 2007.

(51) Int. Cl.

| | |
|---|---|
| ***A63B 47/04*** | (2006.01) |
| ***A47L 13/17*** | (2006.01) |
| ***A63B 55/00*** | (2006.01) |
| *A63B 47/00* | (2006.01) |

(52) U.S. Cl.

CPC ..... *A63B 47/04* (2013.01); *A63B 2047/043* (2013.01); *A63B 47/007* (2013.01); *A63B 2209/10* (2013.01); *A63B 55/008* (2013.01)

USPC ..... 15/210.1; 15/104.93

(58) Field of Classification Search

USPC ..... 15/21.2, 210.1, 104.93; 2/21, 164, 167, 2/168

See application file for complete search history.

(56) References Cited

U.S. PATENT DOCUMENTS 2,530,746 A * 11/1950 Wetherby ..... 15/104.94
2,968,825 A * 1/1961 Wetherby ..... 15/118
3,806,983 A * 4/1974 Cunningham et al. ..... 15/160
4,350,457 A 9/1982 Carnahan
4,442,564 A 4/1984 Berry
5,215,136 A * 6/1993 Flanders et al. ..... 150/160

(Continued)

OTHER PUBLICATIONS

Todd Pitock, Going for the Green, www.getballzee.com/forbes1.asp, Apr. 24, 2006.

*Primary Examiner* — Randall Chin

(74) *Attorney, Agent, or Firm* — Knobbe Martens Olson & Bear LLP

(57) ABSTRACT

A flexible hollow sleeve member comprising an inner core and an outer core, the inner core having a stitch-less inner layer and a stitch-less outer layer, the inner layer of the inner core comprising a water proof bladder made of a moisture-control fabric configured to draw moisture toward the outer layer of the inner core, the outer layer of the inner core comprising a hygroscopic material which absorbs moisture rapidly, the flexible hollow sleeve member having an enclosed upper portion and a lower portion, the lower portion defining an opening that is configured to receive a golf ball, said lower portion having a stretchable lower rim that has an internal diameter that is slightly smaller than the internal diameter of a golf ball, wherein the stretchable lower rim retracts to its original diameter after receipt of the golf ball such that the golf ball is retained in the inner core of the golf ball cleaner for cleaning or temporarily storing the golf ball, the outer core of the flexible hollow sleeve member comprising a versatile synthetic material that is water resistant, wherein the flexible hollow sleeve member is configured to hold moisture in the interior of the flexible hollow sleeve member without allowing excess moisture to seep through to the exterior of the flexible hollow sleeve member.

15 Claims, 4 Drawing Sheets

(56) References Cited

U.S. PATENT DOCUMENTS

| | | | | |
|---|---|---|---|---|
| 5,339,486 | A | 8/1994 | Persic, Jr. | |
| 5,813,080 | A * | 9/1998 | Hendren | 15/209.1 |
| 5,829,086 | A | 11/1998 | Billek | |
| 5,898,968 | A | 5/1999 | Beattie | |
| 6,036,386 | A | 3/2000 | McDonald | |
| 6,148,464 | A | 11/2000 | Shioda | |
| 6,226,827 | B1 * | 5/2001 | English, Jr. | 15/118 |
| 6,594,851 | B2 * | 7/2003 | Sprague | 15/210.1 |
| 2005/0031402 | A1 | 2/2005 | Gomez | |
| 2005/0188482 | A1 | 9/2005 | Matthews | |
| 2007/0039111 | A1 * | 2/2007 | Curtis | 15/160 |
| 2007/0051768 | A1 | 3/2007 | Dobson | |
| 2009/0193598 | A1 * | 8/2009 | Sprague | 15/104.94 |

* cited by examiner

DEVICE AND METHOD FOR CLEANING A GOLF BALL

CROSS-REFERENCE TO RELATED APPLICATIONS

This application claims the benefit of priority of U.S. Provisional Patent Application No. 60/925,652 filed Apr. 23, 2007 hereby incorporated by reference.

FIELD OF THE INVENTION

This invention relates to certain new and useful golf ball cleaner and more particularly to a golf ball cleaner which can be used to store, clean and dry golf balls.

BACKGROUND OF THE INVENTION

For most golfers, clean and dry golf balls are imperative for optimum play. Unfortunately, in the course of playing a round of golf, the typical golfer will soil his or her golf balls quite frequently. To combat this nuisance, most golfers carry a golf towel secured to their golf bag or placed in their golf cart. When the golf ball becomes dirtied or wet, the golfer can bring the golf ball over to the towel and wipe the ball clean. The drawbacks to this mode of cleaning and drying balls are numerous. It is often inconvenient to either hand carry a golf towel or retreat to a golf bag or cart to clean a golf ball. Further, while securing a towel to the golfer's clothing may lessen this inconvenience, the golfer's clothing will eventually become wet or dirty through contact with the progressively soiled towel. Additionally, since most golfers carry one or more golf balls in their pockets during play, if a golf ball is not cleaned before being placed in the pocket, the golfer's pocket will become dirty. There is therefore a need for a device which allows a golfer to conveniently maintain clean and dry golf balls.

SUMMARY OF THE INVENTION

Described herein are devices and methods for cleaning, drying or storing a golf ball, for example, a standard sized golf ball. In one embodiment the device for cleaning, drying or storing the golf ball or the golf ball cleaner includes a flexible hollow sleeve member having an inner core and an outer core where the inner core has a stitch-less inner layer and a stitch-less outer layer. In one embodiment, the non-stitched inner core is sonic welded to the shape of the flexible hollow sleeve member. However, in some embodiments, at least a portion of the inner core of the flexible hollow sleeve member is stitched together. The inner core of the flexible hollow sleeve member can be removably coupled to the outer core of the flexible hollow sleeve member. Thus the inner core can be removed for cleaning, moistening or drying, for example. The outer core of the flexible hollow sleeve member can be made of materials including but not limited to a waterproof breathable fabric, GORE-TEX, neoprene, rubber, vortex, a layer of materials including an abrasion resistant outer shell, a protection material, a GORE-TEX membrane and a soft inner liner, thermo-mechanically expanded polytetrafluoroethylene (PTFE) and other fluoropolymer products, a thin, porous fluoropolymer membrane with a urethane coating that is bonded to a nylon or polyester, or a combination thereof. GORE-TEX® is a registered trademark of W. L. Gore & Associates. In one embodiment, the outermost layer of the outer core is treated with water repellent and seams are sealed to prevent water leakage through pinholes caused during the sewing of the fabric. In another embodiment the outer core is also stitch-less. In some embodiments the inner core can include a micro fiber. The inner layer of the inner core can include a water proof bladder made of a moisture-control fabric configured to draw moisture toward the outer layer of the inner core. The water proof bladder of the inner layer of the inner core can include DRYTEX, an enhanced microfiber, terry cloth or a combination thereof. In one embodiment, the outer layer of the inner core can include a hygroscopic material which absorbs moisture rapidly, where the hygroscopic material is, for example, thermoplastic polyurethane (tpu). In one embodiment the golf ball cleaner only requires a small amount of water to moisturize the golf ball cleaner. For example, one to two tablespoons of water can saturate the inner core of the golf ball cleaner.

In one embodiment, the outer core including, for example neoprene, the inner layer of the inner core, for example DRYTEX, and the outer layer of the inner core, for example, tpu are fused together. In other words all three materials are fused together, for example DRYTEX is fused to the TPU and the TPU is fused with the Neoprene so that the inner core and the outer core are inseparable.

The flexible hollow sleeve member can have an enclosed upper portion and a lower portion where the lower portion defines an opening that can be configured to receive a golf ball. In one embodiment, the lower portion can have a stretchable lower rim that has an internal diameter that is slightly smaller than the internal diameter of a golf ball. The stretchable lower rim can be configured to retract to its original diameter after receipt of the golf ball such that the golf ball is retained in the inner core of the golf ball cleaner for cleaning or temporarily storing the golf ball. In other embodiments, the outer core of the flexible hollow sleeve member can include a versatile synthetic material that is water resistant, for example, rubber. In some embodiments, the flexible hollow sleeve member can be configured to hold moisture in the interior of the flexible hollow sleeve member without allowing excess moisture to seep through to the exterior of the flexible hollow sleeve member. In order to clean a dirty golf ball the inner core can be moisturized by pulling the inner core outwardly, adding moisture to the inner core and returning the inner core back to its original position. The inner core of the flexible hollow sleeve member can be kept dry for drying wet golf balls. In yet another embodiment, the golf ball cleaner can include an attachment device coupled to the closed end of the outer core of the flexible hollow sleeve member. The attachment device can be used to attach the flexible hollow sleeve member to a piece of clothing, for example, belt hook, belt, back pocket, dress pocket or to attach to a golf bag or golf bag or any other golfing device. In some embodiment the golf ball cleaner can be worn around the waistband. The golf ball cleaner can be conveniently attached to any piece of clothing or to a golfing accessory by other methods including for example Velcro.

In some embodiments, a portion of the flexible hollow sleeve member between the upper and the lower portion defines at least one intermediate receiving section having a rim with a diameter that is smaller than the diameter of the opening in the lower portion. The intermediate receiving section can be configured to receive a golf ball where the rim of the intermediate receiving section is expandable and has an internal diameter that is slightly smaller than the internal diameter of the golf ball such that it allows the golf ball to be received and retained in the inner core of the golf ball cleaner for cleaning or temporarily storing the golf ball. The at least one intermediate receiving section can include multiple intermediate receiving sections where the multiple intermediate receiving sections forms multiple cleaning sections or storage sections on the flexible hollow sleeve member. At least one section of the multiple cleaning or storage section can be moisturized to clean dirty golf balls and at least one section of the multiple cleaning or storage section is kept dry for drying a wet golf ball. In one embodiment at least the section closest to the upper section can be moistened to clean the golf ball and the section closest to the lower portion can be kept dry to subsequently dry the clean golf ball. The portion between the opening at the lower portion and the intermediate receiving section can be moisturized to further clean a dirty golf ball or kept dry to further dry a wet golf ball. In one embodiment the diameter of the golf ball cleaner is 1.5 to 2 inches and the length may vary from 6 inches to 12 inches. In one embodiment the golf ball cleaner can have a stretchable receiving end, for example elastic. The elastic receiving end can be between 1.5 to 3.8 inches in diameter.

One advantage of the golf ball cleaner is that it takes into account weather conditions, for example rain. The golf ball cleaner is uniquely configured to absorb moisture so that a wet ball can be cleaned without soaking the outside of the golf ball cleaner. Thus the golf ball cleaner can be wet inside without leaking. In another embodiment the golf ball cleaner includes a terry cloth interior that can be moistened and an outer shell that does not allow excess moisture to seep through. The inner core of the flexible hollow sleeve member can be coupled to the outer core of the flexible hollow sleeve member at the opening of the lower portion of the flexible hollow sleeve member. The inner core can be configured to detach from the outer core, for example, during washing, cleaning or for storing balls. Another advantage is that the inner core, for example microfiber cloth, can be easily washed with warm soapy water and rinsed. The warm water can open up the fibers, allowing them to release the locked in dirt. Also the golf ball cleaner can be easily cleaned by placing the golf ball cleaner in a washing machine and then drying them in a dryer on low heat. Another advantage is that it does not require the use of fabric softeners and ironing the golf ball cleaner is not required.

The golf ball cleaner is portable, light weight and has a generally waterproof baldder. In one embodiment the golf ball cleaner is made microfiber, creating an extremely effective cleaning material that can hold up to seven times its weight in water. In one embodiment the microfiber can be made from a warp knitted thread, composed of wedge-shaped polyester filaments with a core of nylon. The fiber's wedge shaped filaments hollow surfaces, lift up dirt, and then trap the particles inside the fibers. The capillary effect between the filaments and nylon core creates a high absorbency, which in turn enables this cloth to clean and polish at the same time.

The golf ball can be easily cleaned by inserting the golf ball in the golf ball cleaner and, for example, twisting the cleaner a few times. For better performance, simply add water inside the inner core before clipping the golf ball cleaner to clothing or belt, for example. In general, the inner core of the golf ball cleaner should not be wet if the golf ball cleaner is need to dry a golf ball. The golf ball cleaner can also include an attachment device coupled to the bottom portion of the outer core. At the end of a golf game, the golf ball cleaner can be easily unclipped from the golfer's clothing and clipped to the golf bag, for example. The golf ball can be cleaned by inserting the golf ball in the inner core of the golf ball cleaner and rotating the ball inside the lining of the inner core.

BRIEF DESCRIPTION OF THE DRAWINGS

One or more embodiments of the present invention are illustrated by way of example and not limitation in the figures of the accompanying drawings, in which like references indicate similar elements and in which.

DETAILED DESCRIPTION OF THE DRAWINGS

The following description sets forth numerous specific details such as examples of specific devices and methods, and so forth, in order to provide a good understanding of several embodiments of the present invention. It will be apparent to one skilled in the art, however, that at least some embodiments of the present invention may be practiced without these specific details. In other instances, well-known devices or methods are not described in detail or are presented in simple block diagram format in order to avoid unnecessarily obscuring the present invention. Thus, the specific details set forth are merely exemplary. Particular implementations may vary from these exemplary details and still be contemplated to be within the spirit and scope of the present invention.

Figure 1:
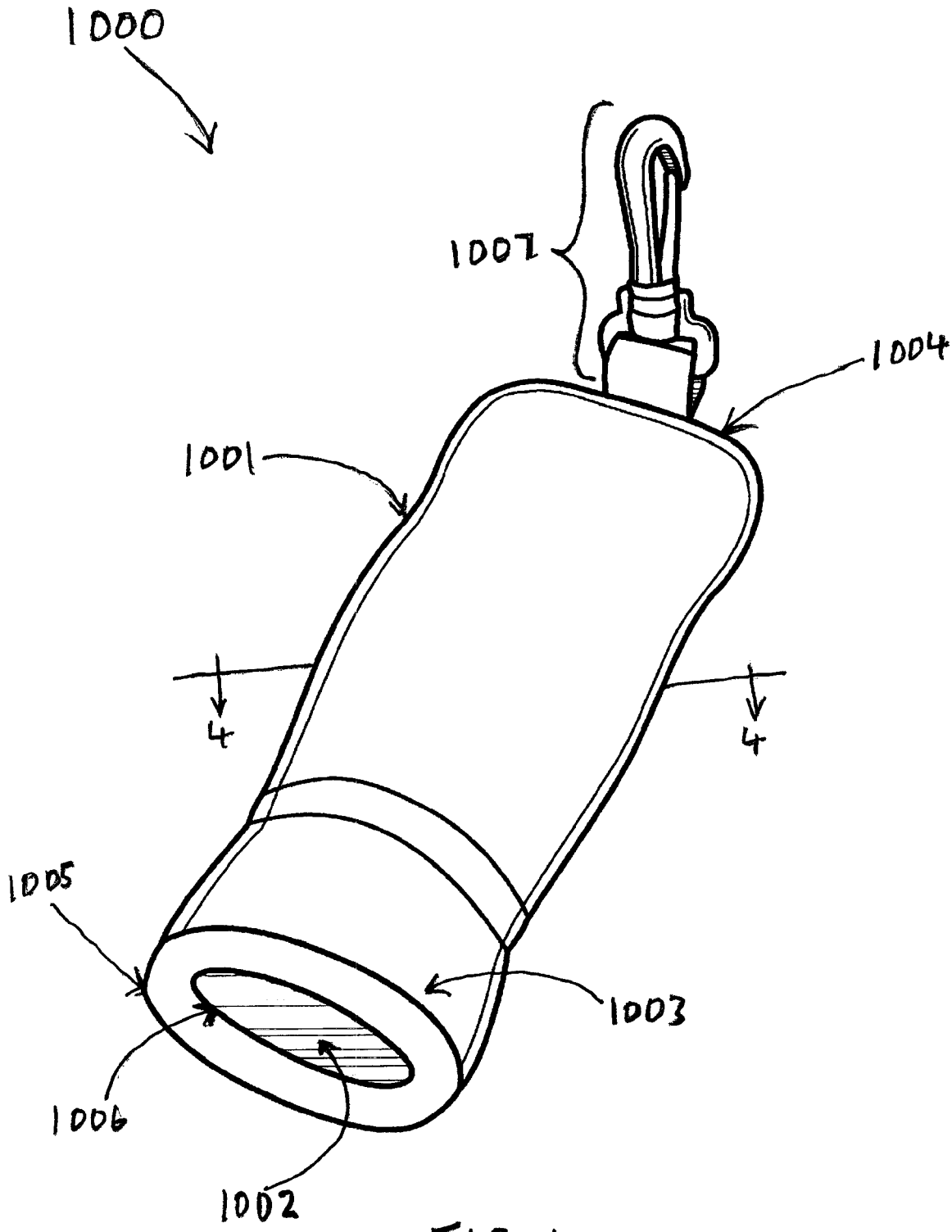
FIG. 1 is a perspective view of the golf ball cleaner showing a hook attached to the upper portion of the golf ball cleaner.

FIG. 1 is a perspective view of the golf ball cleaner showing a hook attached to the upper portion of the golf ball cleaner. In one embodiment the device for cleaning, drying or storing the golf ball or the golf ball cleaner 1000 includes a flexible hollow sleeve member 1001 having an inner core 1002 and an outer core 1003 where the inner core has a stitch-less inner layer and a stitch-less outer layer. In one embodiment, the non-stitched inner core 1002 is sonic welded to the shape of the flexible hollow sleeve member 1001. The flexible hollow sleeve member 1001 can be substantially flat when empty and can assume the shape of a golf ball when full. In some embodiments, at least a portion of the inner core 1002 of the flexible hollow sleeve member is stitched together. The inner core 1002 of the flexible hollow sleeve member 1001 can be removably coupled to the outer core 1003 of the flexible hollow sleeve member. Thus the inner core 1002 can be removed for cleaning, moistening or drying, for example. The outer core 1003 of the flexible hollow sleeve member can be made of materials including but not limited to a waterproof breathable fabric, GORE-TEX, neoprene, rubber, vortex, a layer of materials including an abrasion resistant outer shell, a protection material, a GORE-TEX membrane and a soft inner liner, thermo-mechanically expanded polytetrafluoroethylene (PTFE) and other fluoropolymer products, a thin, porous fluoropolymer membrane with a urethane coating that is bonded to a nylon or polyester, or a combination thereof. GORE-TEX® is a registered trademark of W. L. Gore & Associates. In one embodiment, the outermost layer of the outer core 1003 is treated with water repellent and seams are sealed to prevent water leakage through pinholes caused during the sewing of the fabric. In other embodiments, the outer core 1003 is also stitch-less. In some embodiments the inner core 1002 can include a micro fiber. The inner layer of the inner core 1002 can include a water proof bladder made of a moisture-control fabric configured to draw moisture toward the outer layer of the inner core 1002. The water proof bladder of the inner layer of the inner core 1002 can include DRYTEX, an enhanced microfiber, terry cloth or a combination thereof. DRYTEX® is a registered trademark of Louis Garneau Sports Inc.

In one embodiment, the outer layer of the inner core 1002 can include a hygroscopic material which absorbs moisture rapidly, where the hygroscopic material is, for example, thermoplastic polyurethane (tpu). In one embodiment, the outer core including, for example neoprene, the inner layer of the inner core, for example DRYTEX, and the outer layer of the inner core, for example, tpu are fused together. In other words all three materials are fused together, for example DRYTEX is fused to the TPU and the TPU is fused with the Neoprene so that the inner core and the outer core are inseparable. In one embodiment the golf ball cleaner only requires a small amount of water to moisturize the golf ball cleaner. For example, one to two tablespoons of water can saturate the inner core of the golf ball cleaner.

The flexible hollow sleeve member 1001 can have an enclosed upper portion 1004 and a lower portion 1005 where the lower portion defines an opening that can be configured to receive a golf ball. In one embodiment, the lower portion can have a stretchable lower rim 1006 that has an internal diameter that is slightly smaller than the internal diameter of a golf ball. The stretchable lower rim 1006 can be configured to retract to its original diameter after receipt of the golf ball such that the golf ball is retained in the inner core of the golf ball cleaner for cleaning or temporarily storing the golf ball. In other embodiments, the outer core 1003 of the flexible hollow sleeve member 1001 can include a versatile synthetic material that is water resistant, for example, rubber. In some embodiments, the flexible hollow sleeve member 1001 can be configured to hold moisture in the interior or inner core 1002 of the flexible hollow sleeve member without allowing excess moisture to seep through to the exterior or outer core 1003 of the flexible hollow sleeve member. In order to clean a dirty golf ball the inner core 1002 can be moisturized by pulling the inner core 1002 outwardly, adding moisture to the inner core 1002 and returning the inner core 1002 back to its original position. The inner core 1002 of the flexible hollow sleeve member 1001 can be kept dry for drying wet golf balls. In yet another embodiment, the golf ball cleaner can include an attachment device 1007 coupled to the closed upper portion 1004 of the outer core 1003 of the flexible hollow sleeve member 1001. The attachment device 1007 can be used to attach the flexible hollow sleeve member 1001 to a piece of clothing, for example, belt hook, belt, back pocket, dress pocket or to attach to a golf bag or any other golfing device.

Figure 2:
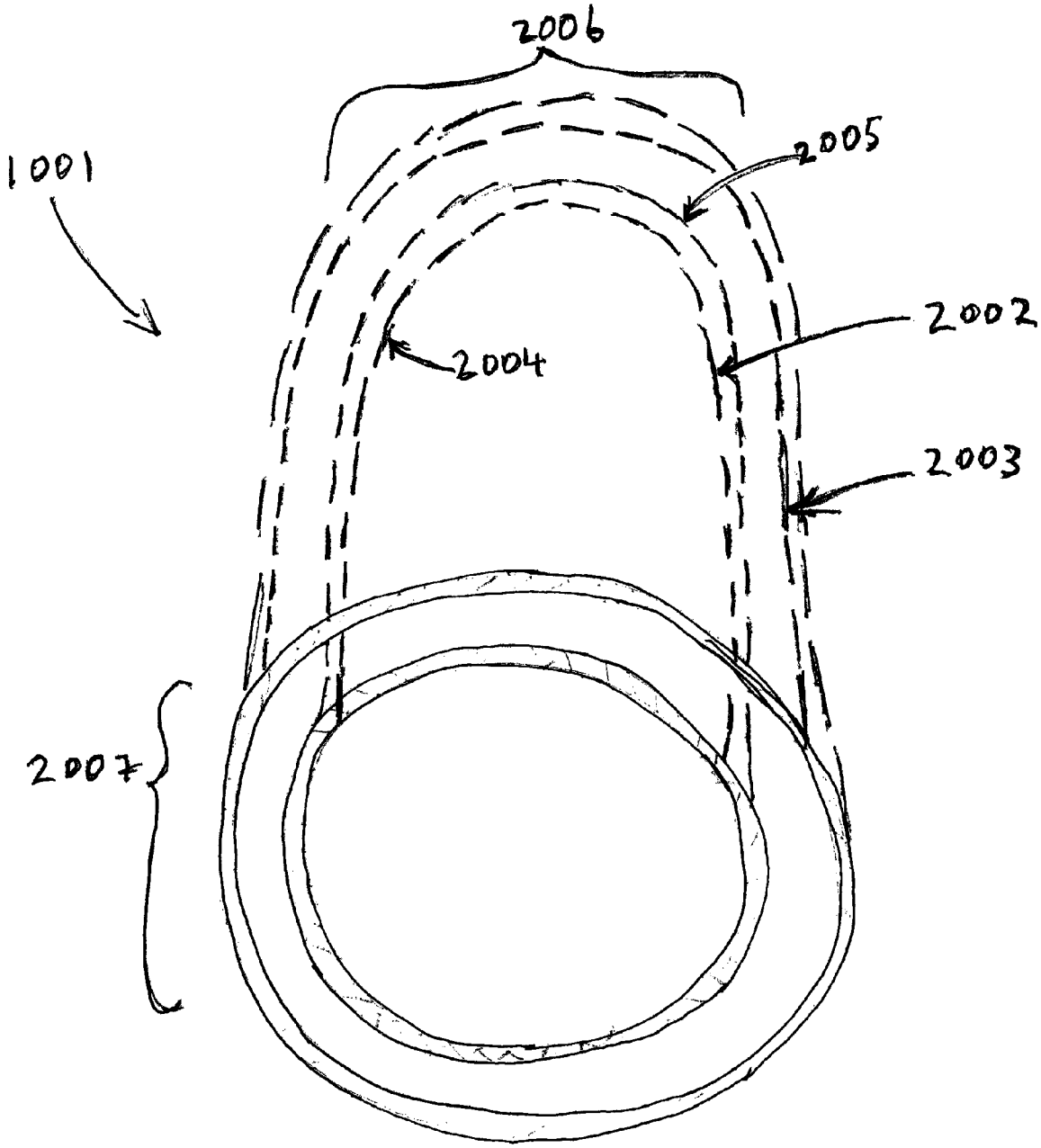
FIG. 2 is a cross sectional view of the golf ball cleaner taken on line 4-4 of FIG. 1.

FIG. 2 is a cross sectional view of the golf ball cleaner taken on line 4-4 of FIG. 1. The golf ball cleaner includes a flexible hollow sleeve member 1001 which includes an inner core 2002 and an outer core 2003, the inner core 2002 having a stitch-less inner layer 2004 and a stitch-less outer layer 2005, the inner layer 2004 of the inner core comprising a water proof bladder made of a moisture-control fabric configured to draw moisture toward the outer layer 2005 of the inner core 2002, the outer layer 2005 of the inner core 2002 can include a hygroscopic material which absorbs moisture rapidly. The flexible hollow sleeve member 1001 can have an enclosed upper portion 2006 and a lower portion 2007. The flexible hollow sleeve member 1001 is configured to hold moisture in the interior or inner core 2002 of the flexible hollow sleeve member 1001 without allowing excess moisture to seep through to the exterior or outer core 2003 of the flexible hollow sleeve member.

Figure 3:
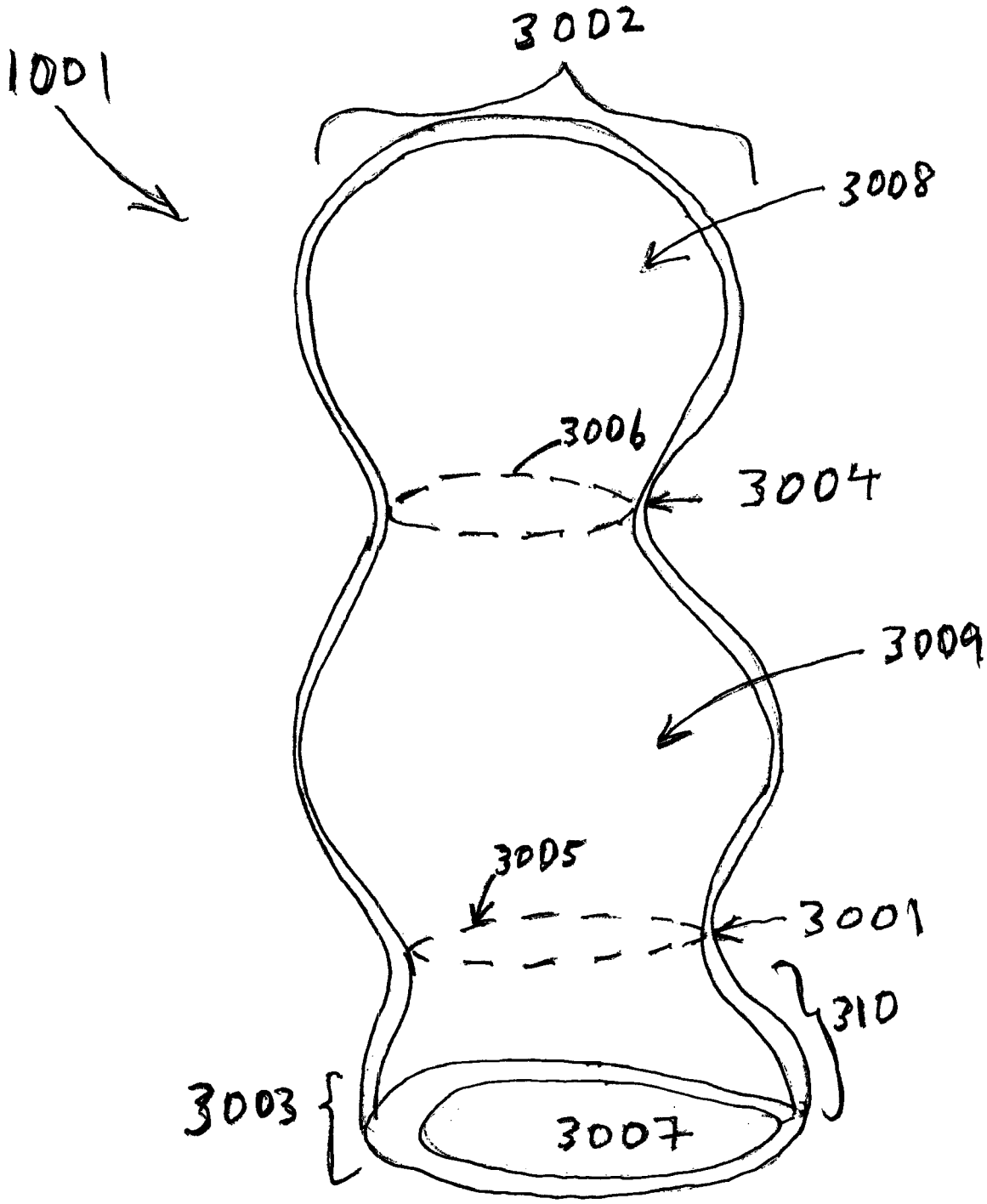
FIG. 3 illustrates one embodiment of a perspective view of the golf ball cleaner.

FIG. 3 illustrates one embodiment of a perspective view of the golf ball cleaner. In this embodiment, a portion of the flexible hollow sleeve member 1001 between the upper portion 3002 and the lower portion 3003 defines at least one intermediate receiving section 3001 or 3004 having a rim 3005 or 3006 with a diameter that is smaller than or equal to the diameter of the opening 3007 in the lower portion 3003. The intermediate receiving section 3001 or 3004 can be configured to receive a golf ball where the rim 3005 or 3006 of the intermediate receiving section 3001 or 3004 can be expandable with an internal diameter that is slightly smaller than the internal diameter of the golf ball such that it allows the golf ball to be received and retained in the inner core of the golf ball cleaner for cleaning or temporarily storing the golf ball. The at least one intermediate receiving section 3001 or 3004 can include multiple intermediate receiving sections 3001 and 3004 where the multiple intermediate receiving sections 3001 and 3004 forms multiple cleaning sections 3008 and 3009, or storage sections on the flexible hollow sleeve member 1001. At least one section of the multiple cleaning or storage section 3008 and 3009 can be moisturized to clean dirty golf balls and at least one section of the multiple cleaning or storage section 3008 and 3009 is kept dry for drying a wet golf ball. In one embodiment at least the storage section 3008 closest to the upper section 3002 can be moistened to clean the golf ball and the storage section 3009 closest to the lower portion 3003 can be kept dry to subsequently dry the clean golf ball. The portion 310 between the opening at the lower portion and the intermediate receiving section can be moisturized to further clean a dirty golf ball or kept dry to further dry a wet golf ball.

Figure 4:
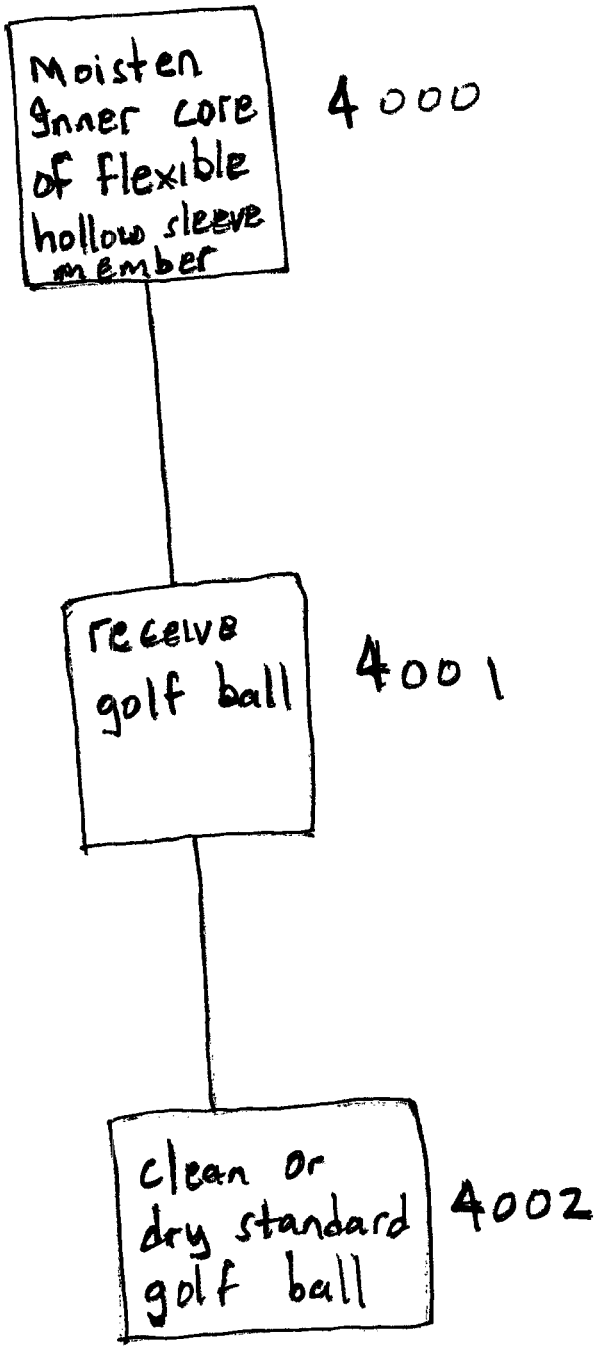
FIG. 4 is a flow diagram illustrating an example process of cleaning a golf ball.

FIG. 4 is a flow diagram illustrating an example process of cleaning a golf ball. The illustrated process may be facilitated by the golf ball cleaner 1000 that was previously described with respect to FIG. 1 and FIG. 2. Initially in step 4000, moisten the inner core of the flexible hollow sleeve member of the golf ball cleaner 1000 with a cleaning liquid (for example water), where the flexible hollow sleeve member comprises the inner core and an outer core. The inner core of the flexible hollow sleeve member having an inner layer and an outer layer where the inner layer of the inner core includes a water proof bladder made of a moisture-control fabric configured to draw moisture toward the outer layer of the inner core. The outer layer of the inner core can include a material which absorbs moisture rapidly. The flexible hollow sleeve member can have an enclosed upper portion and a lower portion having an opening, where a portion of the flexible hollow sleeve member between the upper and the lower portion define at least an intermediate receiving section. The intermediate receiving section can have a rim with a diameter that is smaller than the diameter of the opening in the lower portion. The intermediate receiving section can be configured to receive a golf ball, where the rim of the intermediate receiving section is expandable and has an internal diameter that is slightly smaller than the internal diameter of a golf ball such that it allows the golf ball to be received and retained in the inner core of the golf ball cleaner for cleaning or temporarily storing. The outer core of the flexible hollow sleeve member can include a versatile synthetic rubber material that is water resistant, where the flexible hollow sleeve member can be configured to hold moisture in the interior of the flexible hollow sleeve member without allowing excess moisture to seep through to the exterior of the flexible hollow sleeve member. The process then continues to step 4001 where the golf ball is received in the inner core of the flexible hollow sleeve member through the opening in the lower portion of the flexible hollow sleeve member. This receiving step can also include receiving the golf ball in the intermediate receiving section by squeezing the golf ball through the expandable rim of the intermediate receiving section. The expandable rim can be configured to retract to its original diameter when the golf ball is completely received in the inner core of the flexible hollow sleeve member. Finally in step 4002, the golf ball is cleaned or dried by rotating the golf ball in the inner core of the flexible hollow sleeve member. In one embodiment the golf ball can be stored in the inner core of the flexible hollow sleeve member. The golf ball can subsequently be released from the inner core of the flexible hollow sleeve member.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A flexible golf ball cleaning device comprising:

an outer core comprising a rubber, wherein the outer core is at least partially waterproof and configured to limit passage of moisture from an exterior of the outer core to the inner core, the outer core having a length of at least six inches;

an inner core positioned at least partially within the outer core, the inner core configured to at least partially absorb moisture, wherein the inner core is configured to limit passage of moisture from an interior of the inner core to the outer core;

wherein at least a portion of the inner core is stitched;

wherein the inner core comprises an inner layer and an outer layer, the outer layer being positioned between the outer core and the inner layer of the inner core;

wherein the inner layer of the inner core comprises a moisture-control material having high absorbency properties enabling the moisture-control material to hold seven times its weight in water, the moisture-control material configured to draw moisture toward the outer layer of the inner core;

wherein the outer layer of the inner core comprises sonic welded thermoplastic polyurethane, the outer layer of the inner core being stitch-less to limit the passage of moisture to the outer core;

an opening along one end of the cleaning device, wherein the opening is sized and configured to permit an object to be inserted within the interior of the inner core for cleaning, polishing, and drying of said object by the inner layer of the inner core;

wherein the inner core is at least partially attached to the outer core along the opening; and an attachment device coupled to the cleaning device adjacent a closed end of the cleaning device, the closed end positioned opposite the opening.

2. The cleaning device of claim 1, wherein the rubber of the outer core comprises neoprene.

3. The cleaning device of claim 1, wherein the inner core is permanently or removably attached to the outer core.

4. The cleaning device of claim 1, wherein the opening is at least partially stretchable to facilitate passage of the object being cleaned within the interior of the inner core.

5. The cleaning device of claim 1, wherein a cross-sectional dimension of the opening is smaller than a cross-sectional dimension of the interior of the inner core along at least one location of the inner core.

6. The cleaning device of claim 1, wherein the object being cleaned comprises a golf ball.

7. A flexible golf ball cleaning device comprising:

an inner core defining an interior space, at least a portion of the inner core being stitched;

an outer core positioned at least partially around the inner core, the outer core comprising a rubber, wherein the outer core is at least partially waterproof;

wherein the inner core is configured to limit a passage of moisture from the interior space to the outer core; and wherein the inner core comprises a moisture-control material with high absorbency properties, the moisture-control material configured to draw moisture into the inner core;

an opening along one end of the cleaning device, wherein the opening is sized and configured to permit a golf ball to be positioned within the interior space of the inner core;

wherein the inner core is at least partially attached to the outer core along at least a portion of the cleaning device; and wherein, when in use, the moisture-control material permits a golf ball positioned through the opening and in the interior space to be simultaneously cleaned, polished, and dried by moving the inner core relative to the golf ball;

wherein the inner core comprises at least one stitch-less layer to help limit the passage of moisture to the outer core, the at least one stitch-less layer comprising thermoplastic polyurethane;

wherein the moisture-control material is configured to be capable of holding hold seven times its weight in water.

8. The cleaning device of claim 7, wherein the outer core comprises a length of at least six inches.

9. A flexible golf ball cleaning device comprising:

a first layer defining an interior of the cleaning device, the interior being configured to receive a golf ball, wherein the first layer comprises a moisture-control material having high absorbency properties that enable the moisture-control material to hold seven times its weight in water;

a second layer positioned adjacent the first layer, the second layer comprising a thermoplastic polyurethane;

a third layer positioned adjacent the second layer, wherein the second layer is positioned between the first layer and the third layer, and wherein the second layer is configured to limit passage of moisture from the first layer to the third layer, the third layer comprising a rubber, the third layer being at least partially waterproof;

an opening along one end of the cleaning device, wherein the opening is sized to permit a golf ball to be positioned within the interior of the cleaning device;

wherein the first, second and third layers are attached to one another along at least a portion of the cleaning device; and wherein, when in use, a golf ball positioned within the interior of the cleaning device is selectively cleaned, polished, and dried by moving the first layer relative to the golf ball.

10. The cleaning device of claim 9, wherein the second layer is stitch-less to help limit the passage of moisture from the first layer to the third layer.

11. The cleaning device of claim 9, further comprising an attachment device coupled to the cleaning device adjacent a closed end of the cleaning device, the closed end positioned opposite the opening.

12. The cleaning device of claim 9, wherein the opening is at least partially stretchable.

13. The cleaning device of claim 9, wherein a cross-sectional dimension of the opening is smaller than a cross-sectional dimension of the interior of the cleaning device along at least one location of the cleaning device.

14. A flexible golf ball cleaning, polishing, and drying device comprising:

an outer core comprising a rubber, wherein the outer core is at least partially waterproof and configured to limit passage of moisture from an exterior of the outer core to the inner core;

an inner core positioned at least partially within the outer core, the inner core configured to at least partially absorb moisture, wherein the inner core is configured to limit passage of moisture from an interior of the inner core to the outer core, the inner core being at least partially stitched to itself;

wherein the inner core comprises an inner layer and an outer layer, the outer layer being positioned between the outer core and the inner layer of the inner core, the outer layer comprising a sonic-welded thermoplastic polyurethane;

wherein the inner layer of the inner core comprises a moisture-control material configured to draw moisture toward the outer layer of the inner core; and an opening along one end of the cleaning device, wherein the opening is sized and configured to permit an object to be inserted within the interior of the inner core for cleaning said object;

wherein the inner core is at least partially attached to the outer core along the opening.

15. The cleaning device of claim 14, wherein the outer layer of the inner core is stitch-less;

wherein the outer core comprises a length of at least six inches; and wherein the moisture-control material is configured to hold at least seven times its weight in water.

* * * * *